US006351071B1

(12) United States Patent
Itoh

(10) Patent No.: US 6,351,071 B1
(45) Date of Patent: Feb. 26, 2002

(54) MAGNETRON APPARATUS AND MANUFACTURING METHOD THEREFOR

(75) Inventor: Takeshi Itoh, Osaka Pref. (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/432,436

(22) Filed: Nov. 2, 1999

(30) Foreign Application Priority Data

Nov. 18, 1998 (JP) ..... 10-327812

(51) Int. Cl.[7] ..... H01J 25/50
(52) U.S. Cl. ..... 315/39.51
(58) Field of Search ..... 315/39.51, 39.53; 313/35, 36

(56) References Cited

U.S. PATENT DOCUMENTS

| | | | | |
|---|---|---|---|---|
| 3,577,033 A | * | 5/1971 | Aoki et al. | 315/39.71 |
| 5,548,105 A | | 8/1996 | Butterworth et al. | 219/761 |

FOREIGN PATENT DOCUMENTS

| | | |
|---|---|---|
| DE | 41 35 896 A1 | 5/1992 |
| GB | 2243258 | * 10/1991 |
| JP | 0061470 | * 5/1977 |
| JP | 0083131 | * 6/1980 |
| JP | 0031330 | * 2/1989 |
| JP | 0112132 | * 4/1990 |
| JP | 403297034 | * 12/1991 |
| JP | 04004544 | 1/1992 |
| JP | 05303939 | 11/1993 |
| JP | 10125243 | 5/1998 |

* cited by examiner

*Primary Examiner*—Don Wong
*Assistant Examiner*—Ephrem Alemu
(74) *Attorney, Agent, or Firm*—Sheridan Ross P.C.

(57) ABSTRACT

A magnetron apparatus and a manufacturing method therefor according to the present invention comprises a magnetron having a tubular anode and a cathode, a magnetic circuit having first and second magnets disposed around the upper and lower opening end portions of the tubular anode, respectively, and a yoke disposed enclosing the tubular anode and the first and second magnets, and a radio wave leakage preventor having a filter case and LC filter circuit components disposed inside the filter case, wherein at least the filter case is filled with an insulating cooling liquid.

17 Claims, 8 Drawing Sheets

MAGNETRON APPARATUS AND MANUFACTURING METHOD THEREFOR

BACKGROUND OF THE INVENTION

The present invention relates to a magnetron apparatus for use in a microwave appliance, such as a microwave oven, and a method for manufacturing the magnetron apparatus.

The above-mentioned magnetron apparatus is a microwave oscillation tube operating at a fundamental frequency of, for example, 2,450 MHz and is used as a high-frequency source in an electric appliance (e.g. microwave appliance) using the microwaves. More specifically, a magnetron apparatus is used for microwave heaters such as microwave oven and industrial heater, or a gas excitation apparatus for lighting a microwave discharge lamp. This kind of magnetron apparatus generally comprises a cathode, a tubular anode disposed around the cathode and a resonant cavity formed in the inner space of the tubular anode. Furthermore, in the magnetron apparatus, as is well known, LC filter circuit components including a capacitor and choke coils are connected to the cathode to prevent leakage of high-frequency noise.

In the above-mentioned magnetron apparatus, the temperature of the cathode becomes high during operation thereof. The heat generated at the cathode heats other components, thereby adversely affecting the components. Therefore, in the magnetron apparatus, technical task must be solved to prevent adverse effects due to temperature rising during operation, thereby to prevent changes in the characteristics of the magnetron apparatus.

As a conventional magnetron apparatus developed to solve the above-mentioned problems, a liquid-cooled magnetron apparatus is disclosed in Japanese Laid-open Patent Application No. Hei 4-4544, for example.

This conventional magnetron apparatus will be described below specifically, referring to FIG. 8.

FIG. 8 is a partially cutaway sectional view showing a configuration of a conventional magnetron apparatus.

As shown in FIG. 8, the conventional magnetron apparatus comprises a magnetron part 51, a magnetic circuit part 53 for forming a magnetic circuit, and a radio wave leakage prevention part 57 for preventing leakage of high-frequency noise.

The magnetron part 51 comprises a tubular anode 52 and a cathode (not shown) disposed inside the tubular anode 52, and causes oscillation to generate a microwave having a predetermined fundamental frequency.

The magnetic circuit part 53 comprises magnets 54*a* and 54*b* disposed around the upper and lower opening end portions of the above-mentioned tubular anode 52, respectively, and a case-shaped yoke 55 containing the tubular anode 52 and the magnets 54*a* and 54*b*. The yoke 55 is provided with a supply port 56*a* for supplying a cooling liquid 60 to the inner space of the yoke 55 and an outlet port 56*b* for discharging the cooling liquid 60. The inner space of the yoke 55 is sealed with the tubular anode 52, a rubber packing members 61, and the magnets 54*a* and 54*b*. An adhesive (not shown) is coated between the yoke 55 and the magnets 54*a* and 54*b*. The inner space of the yoke 55 is filled with the cooling liquid 60, such as water, thereby directly cooling the tubular anode 52, the magnets 54*a* and 54*b*, and the yoke 55.

The radio wave leakage prevention part 57 is provided with a metallic filter case 58 and a capacitor 59, one end of which is connected to the above-mentioned cathode inside the filter case 58. The other end of the capacitor 59 is taken out of the filter case 59 as shown in FIG. 8, and connected to an electric power source (not shown).

With the above-mentioned configuration, the conventional magnetron apparatus is intended to prevent temperature rising at the tubular anode 52 and the magnets 54*a* and 54*b* during operation, thereby to decrease changes in characteristics.

However, the application voltage (electric power source voltage) of the above-mentioned conventional magnetron apparatus during operation is generally in the range of 4 to 5 kV. For this reason, in the radio wave leakage prevention part 57 of the conventional magnetron apparatus, the distance between the filter case 58 (the ground potential side) and the capacitor 59 (the electric power source potential side) disposed in the filter case 58 is required to be kept at a distance (hereinafter referred to as "an insulation distance") enough to withstand the above-mentioned application voltage. Therefore, the filter case 58 of the conventional magnetron apparatus cannot be made small, thereby making it difficult to miniaturize the configuration of the magnetron apparatus. Furthermore, if the insulation distance is insufficient, a discharge phenomenon occurs between the filter case 58 and the connection point to the cathode of the capacitor 59 during operation, thereby causing improper apparatus operation.

In addition, in the conventional magnetron apparatus, the heat caused at the cathode is directly transferred to the capacitor 59, thereby raising the temperature of the capacitor 59 to a high temperature of 120 to 150° C. As a result, the capacitor 59 of the conventional magnetron apparatus is burnt and deteriorated, thereby causing a problem of lowering its noise prevention performance significantly.

BRIEF SUMMARY OF THE INVENTION

The object of the present invention is to provide a magnetron apparatus that can solve the aforementioned problems in the conventional magnetron apparatus.

In order to achieve the above-mentioned object, the magnetron apparatus of the present invention comprises:

a magnetron having a tubular anode and a cathode, a magnetic circuit having first and second magnets disposed around the upper and lower opening end portions of the tubular anode, respectively, and a yoke disposed enclosing the tubular anode and the first and second magnets, and a radio wave leakage preventor having a filter case and LC filter circuit components disposed inside the filter case, an insulating cooling liquid filled in at least the filter case.

According to the above-mentioned configuration, the adverse influence of temperature rising during operation is lowered, whereby burning and deterioration of the LC filter circuit components are reduced, and the magnetron apparatus can be miniaturized.

A magnetron apparatus according to another aspect of the present invention comprises: the tubular anode of the magnetron has cooling fins around the outer peripheral portion of the tubular anode, beside the aforementioned configuration.

According to the above-mentioned configuration, the temperature rising at the tubular anode and the magnets can be reduced further. In addition, this can reduce drop in the output of the magnetron apparatus.

A magnetron apparatus according to another aspect of the present invention comprises: the insulating cooling liquid is supplied from a supply port, beside the aforementioned configuration.

According to the above-mentioned configuration, the insulating cooling liquid can be supplied easily at the final manufacturing step of the magnetron apparatus, or at the time when the magnetron apparatus is installed in a microwave appliance.

A magnetron apparatus according to another aspect of the present invention comprises: the insulating cooling liquid is discharged from an outlet port, beside the aforementioned configuration.

According to the above-mentioned configuration, the insulating cooling liquid is circulated between the filter case and an outside apparatus, whereby the LC filter circuit components can be cooled efficiently. Furthermore, the temperature of the insulating cooling liquid in the magnetic circuit and the radio wave leakage preventor can be maintained at a constant value at all times. This stabilizes the noise prevention performance and the output performance of the magnetron apparatus.

A magnetron apparatus according to another aspect of the present invention comprises: a cooling liquid storage tank is provided between the supply port and the outlet port, so that the insulating cooling liquid circulates, beside the aforementioned configuration.

According to the above-mentioned configuration, the insulating cooling liquid is circulated between the filter case and an outside apparatus, whereby the LC filter circuit components can be cooled efficiently. Furthermore, the temperature of the insulating cooling liquid in the magnetic circuit and the radio wave leakage preventor can be maintained at a constant value at all times. This stabilizes the noise prevention performance and the output performance of the magnetron apparatus.

A magnetron apparatus according to another aspect of the present invention comprises: inside a space of the yoke is filled with the insulating cooling liquid, beside the aforementioned configuration.

According to the above-mentioned configuration, the tubular anode, the magnets and the yoke can be cooled directly.

A magnetron apparatus according to another aspect of the present invention comprises: the magnetic circuit is enclosed in the filter case, beside the aforementioned configuration.

According to the above-mentioned configuration, it is not necessary to change existing main components, such as the magnetron and the magnetic circuit, whereby it is possible to prevent the cost of the apparatus from rising. In other words, it is not necessary to prepare new working facilities, such as metal molds for the main components.

A magnetron apparatus according to another aspect of the present invention comprises: the yoke is a part of the filter case, beside the aforementioned configuration.

According to the above-mentioned configuration, the tubular anode, the magnets and the yoke can be cooled directly. Further, it is possible to decrease numbers of the components in the magnetron apparatus, and to miniaturize the magnetron apparatus.

A magnetron apparatus according to another aspect of the present invention comprises: a communicating portion is provided for communicating the space inside the magnetic circuit with the space inside the radio wave leakage preventor, beside the aforementioned configuration.

According to this structure, a difference in temperature occurs between the insulating cooling liquid in the magnetic circuit and the insulating cooling liquid in the radio wave leakage preventor during operation of the apparatus. This causes natural convection of the insulating cooling liquid between the magnetic circuit and the radio wave leakage preventor, thereby circulating the insulating cooling liquid.

A magnetron apparatus according to another aspect of the present invention comprises: the communicating portion is provided with the central hole of one of the magnets disposed on the side of the radio wave leakage preventor, beside the aforementioned configuration.

According to the above-mentioned configuration, the magnet on the side of the radio wave leakage preventor can be cooled efficiently. Furthermore, this prevents upsizing of the apparatus.

A method for manufacturing a magnetron apparatus comprising a magnetron, a magnetic circuit and a radio wave leakage preventor, wherein after connecting said magnetic circuit and said radio wave leakage preventor to each other, an insulating cooling liquid is supplied into the filter case of said radio wave leakage preventor.

According to the above-mentioned configuration, the insulating cooling liquid can be supplied at the final manufacturing step of the magnetron apparatus, or at the time when the magnetron apparatus is installed in a microwave appliance. Therefore, it is possible to prevent contamination due to spill or splash of the insulating cooling liquid at steps before the final step.

DETAILED DESCRIPTION OF THE INVENTION

Preferred embodiments of a magnetron apparatus and a manufacturing method therefor according to the present invention will be described below referring to the accompanying drawings.

<<First Embodiment>>

[Configuration of the Magnetron Apparatus]

Figure 1:
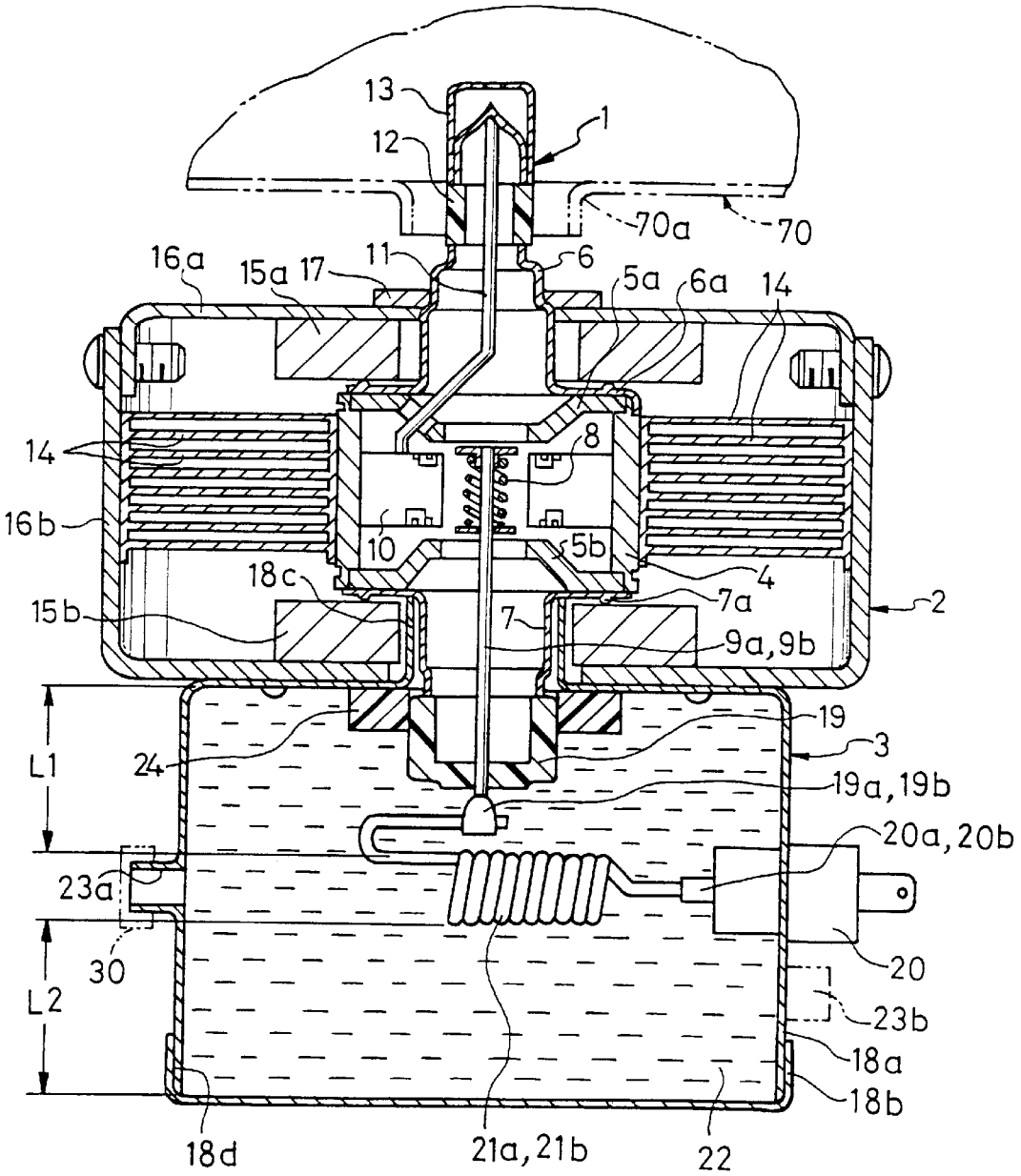
FIG. 1 is a sectional view showing a configuration of a magnetron apparatus in a first embodiment of the present invention.
Figure 2:
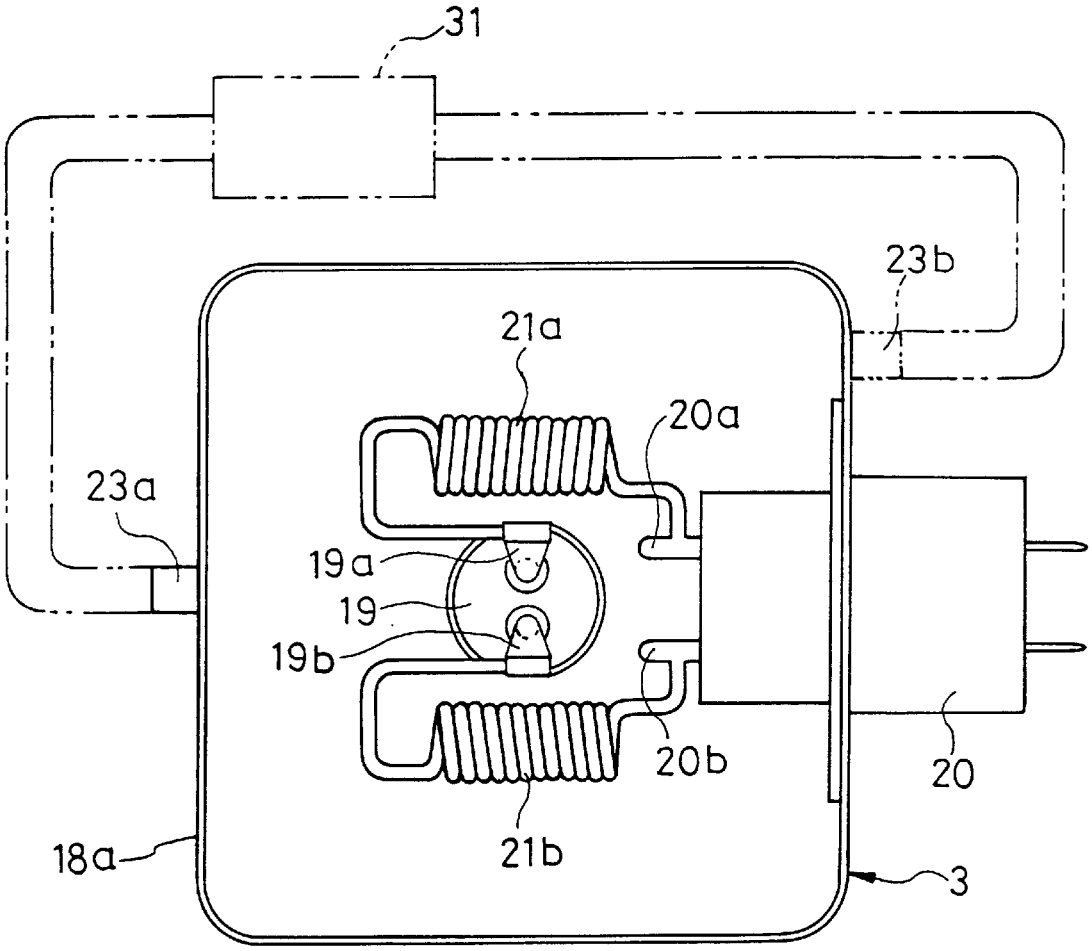
FIG. 2 is a bottom view showing a configuration of the bottom portion of the magnetron apparatus shown in FIG. 1.

FIG. 1 is a sectional view showing a configuration of a magnetron apparatus in a first embodiment of the present invention, and FIG. 2 is a bottom view showing a configuration of the bottom portion of the magnetron apparatus shown in FIG. 1.

As shown in FIGS. 1 and 2, the magnetron apparatus of the present embodiment comprises a magnetron part 1, a magnetic circuit part 2 for exciting the magnetron part 1, and a radio wave leakage prevention part 3 having LC filter circuit components for preventing leakage of high-frequency noise.

The magnetron part 1 comprises a tubular anode 4, first and second magnet pole pieces 5*a* and 5*b* disposed at the upper and lower opening end portions of the tubular anode 4, respectively, and grommetted first and second metal cylinders 6 and 7 disposed in the first and second magnet pole pieces 5*a* and 5*b*, respectively. The outer end surface of the first magnet pole piece 5*a* is covered with a flange portion 6*a* disposed at one end portion of the first metal cylinder 6, and the outer peripheral fringe of the flange portion 6*a* is secured to the upper opening end portion of the tubular anode 4.

At the other end portion of the first metal cylinder 6, an output antenna 13 is sealably disposed via an insulation ring 12. In the same way, the outer end surface of the second magnet pole piece 5*b* is covered with a flange portion 7*a* disposed at one end portion of the second metal cylinder 7, and the outer peripheral fringe of the flange portion 7*a* is secured to the lower opening end portion of the tubular anode 4. A cathode stem 19 described below is sealably disposed at the other end portion of the second metal cylinder 7. The tubular anode 4 and the output antenna 13 are made of oxygen free copper, for example. In addition, the first and second magnet pole pieces 5*a* and 5*b* are made of a magnetic material, such as iron.

A coil-shaped cathode filament 8 disposed around the center axis of the tubular anode 4, and a plurality of anode segments 10 disposed concentrically and radially around the cathode filament 8 to form a resonance cavity are provided inside the tubular anode 4. The cathode filament 8 is formed of tungsten, for example, and both ends thereof are connected to a pair of cathode leads 9*a* and 9*b* inside the tubular anode 4. Inside the tubular anode 4, for example, ten anode segments 10 are disposed at equal intervals. The anode segments 10 are made of oxygen free copper, for example. The cathode leads 9*a* and 9*b* are taken out from the inside of the tubular anode 4 via the cathode stem 19, and connected to a high-frequency electric power source (not shown). Inside the tubular anode 4, an output conductor 11, connected at one end thereof to the output antenna 13, is connected to one of the anode segments 10. The magnetron apparatus emits a microwave having a fundamental frequency of, for example, 2,450 MHz from the output antenna 13. The output antenna 13 is disposed inside the waveguide 70*a* of a microwave appliance 70 incorporating the present magnetron apparatus.

On the outer peripheral surface of the tubular anode 4, a plurality of fins 14 are disposed in multistages to radiate heat generated inside the tubular anode 4.

The magnetic circuit part 2 comprises ring-shaped first and second magnets 15*a* and 15*b* disposed on both end sides of the tubular anode 4 of the magnetron part 1, yoke members 16*a* and 16*b* enclosing the tubular anode 4 and the first and second magnets 15*a* and 15*b*, respectively, and a ring-shaped electrically conductive gasket 17 for electric connection to the waveguide 70*a* by mechanical tightening. More specifically, on the outer peripheral end surface of the first magnet pole piece 5*a*, the ring-shaped first magnet 15*a* is disposed concentrically with and on the flange portion 6*a*. One of the magnet poles of the first magnet 15*a* is magnetically coupled to the first magnet pole piece 5*a*. In the same way, on the outer peripheral end surface of the second magnet pole piece 5*b*, the ring-shaped second magnet 15*b* is disposed concentrically on the flange portion 7*a*. One of the magnet poles of the second magnet 15*b* is magnetically coupled to the second magnet pole piece 5*b*. The other magnet poles of the first and second magnets 15*a* and 15*b* are coupled to each other by the yoke members 16*a* and 16*b*. The magnets 15*a* and 15*b* are each formed of a permanent magnet made of ferrite including strontium and barium. The gasket 17 is formed of a metal mesh made of brass, stainless steel or the like in a ring shape. The inner diameter portion of the gasket 17, making contact with the outer diameter portion of the first metal cylinder 6, is made so as to be smaller than the outer diameter portion of the first metal cylinder 6. In addition, the yoke members 16*a* and 16*b* are made of a magnetic material such as iron, and formed in a frame shape with its front and rear parts open for passing cooling medium (e.g. air). The above-mentioned cathode filament 8, tubular anode 4, first and second magnet pole pieces 5*a* and 5*b*, first and second metal cylinders 6 and 7, first and second magnets 15*a* and 15*b* and fins 14 are all contained in the container formed by the yoke members 16*a* and 16*b*.

The radio wave leakage prevention part 3 is provided immediately beneath the yoke member 16*b*, and comprises filter case members 18*a* and 18*b*, the cathode stem 19 having a pair of stem terminals 19*a* and 19*b*, a high-voltage capacitor 20 having terminals 20*a* and 20*b* disposed inside the filter case member 18*a* and 18*b*, and a pair of choke coils 21*a* and 21*b*. The choke coil 21*a* is disposed and connected between the stem terminal 19*a* and the terminal 20*a* of the high-voltage capacitor 20, and the choke coil 21*b* is disposed and connected between the stem terminal 19*b* and the terminal 20*b* of the high-voltage capacitor 20. The high-voltage capacitor 20 and the choke coils 21*a* and 21*b* constitute the above-mentioned LC filter circuit components. The filter case members 18*a* and 18*b* are configured so as to contain sealed inner space therein. And an insulating cooling liquid 22 is filled in the inner space. More specifically, a supply port 23*a* is provided on the filter case member 18*a*. The supply port 23*a* is used for filling the insulating cooling liquid 22 including a coolant liquid having high dielectric strength or a transformer oil (silicone oil or insulating oil, for example) therethrough used for high-voltage transformers, into the space formed inside the filter case members 18*a* and 18*b*. The supply port 23*a* is closed with a plug 30 shown by a two-dot lines of FIG. 1. With this configuration, the insulating cooling liquid 22 is filled in the space inside the filter case members 18*a* and 18*b*. A ring shaped packing 24 is used for sealing a gap between the filter case member 18*a* and the second metal cylinder 7. For example, a silicone-based adhesive is coated with the gap.

[Manufacturing Method]

A method for manufacturing the magnetron apparatus of the present embodiment will be described below specifically referring to FIG. 3.

Figure 3:
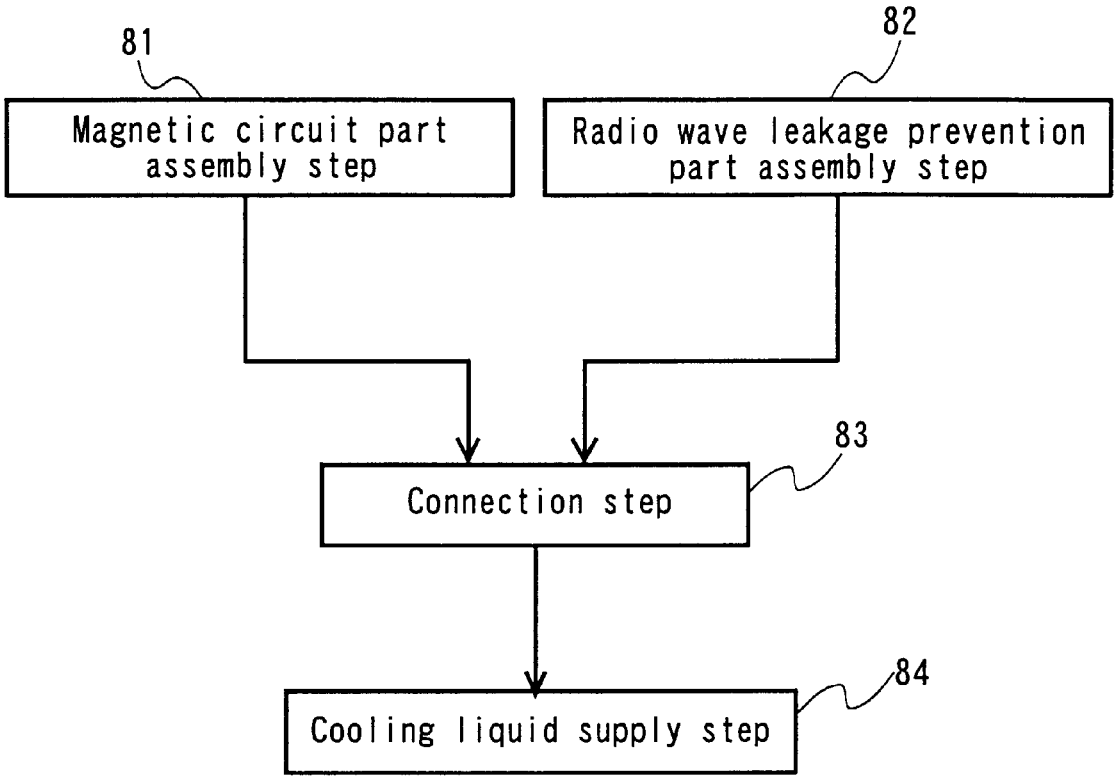
FIG. 3 is a manufacturing step diagram showing a configuration of a method for manufacturing the magnetron apparatus shown in FIG. 1.

FIG. 3 is a manufacturing step diagram showing a configuration of a method for manufacturing the magnetron apparatus shown in FIG. 1.

As shown in FIG. 3, the method for manufacturing the magnetron apparatus of the present embodiment comprises a magnetic circuit part assembly step 81 for forming the magnetic circuit part 2, and a radio wave leakage prevention part assembly step 82 for forming the radio wave leakage prevention part 3. Further, the method for manufacturing the magnetron apparatus has a connection step 83 for connecting the magnetic circuit part assembly step 81 to the radio wave leakage prevention part assembly step 82, and a cooling liquid supply step 84 for supplying the insulating cooling liquid 22 into the space inside the filter case members 18*a* and 18*b*.

More specifically, in the magnetic circuit part assembly step 81, there are additional steps such that the yoke member 16*a,* the first magnet 15*a,* the magnetron part 1, the second magnet 15*b* and the yoke member 16*b* are overlaid in succession and disposed on an assembly jig (not shown). After this, the yoke member 16*a* and the yoke member 16*b* are secured to each other by using tightening components, such as screws, thereby to form the magnetic circuit part 2. Next, the gasket 17 is fitted over the first metal cylinder 6*a* of the magnetron part 1 and mounted on the yoke member 16*a.*

Simultaneously, in the radio wave leakage prevention part assembly step 82, the high-voltage capacitor 20 is connected to the choke coils 21*a* and 21*b,* and installed at a designated position on one side surface of the filter case member 18*a.*

In the connection step 83, the cylindrical portion 18*c* of the filter case member 18*a* is inserted between the inner peripheral surface of the second magnet 15*b* and the outer peripheral surface of the second metal cylinder 7 in the yoke member 16*b.* And the filter case member 18*a* is secured to the yoke member 16*b* of the magnetic circuit part 2 by using tightening components, such as swaging pins or screws. After this, the clearance between the filter case member 18*a* and the magnetron part 1 is closed by using the rubber packing 24, a silicone-based adhesive and the like. Next, one end of the choke coil 21*a* and one end of the choke coil 21*b* are connected to the stem terminals 19*a* and 19*b,* respectively. The filter case member 18*a* is then combined with the filter case member 18*b,* and the combination surface 18*d* thereof is welded. As a result, the magnetic circuit part 2 is connected to the radio wave leakage prevent part 3, thereby sealing the space inside the filter case members 18*a* and 18*b,* except for the supply port 23*a.*

In the cooling liquid supply step 84 used as the final step, the filter case members 18*a* and 18*b* together forming the radio wave leakage prevention part 3 are positioned with the supply port 23*a* upward, and the insulating cooling liquid 22 is supplied from the supply port 23*a* into the space inside the filter case members 18*a* and 18*b,* and the supply port 23*a* is closed with the plug 30.

Next, the actions and effects of the magnetron apparatus according to the above-mentioned present embodiment will be described below.

In the magnetron apparatus according to the present embodiment, the space inside the filter case members 18*a* and 18*b* is sealed, and the insulating cooling liquid 22 is filled in the space inside the filter case members 18*a* and 18*b.* Therefore, in the magnetron apparatus according to the present embodiment, the choke coils 21*a* and 21*b* and the high-voltage capacitor 20 can be cooled, and the insulation distances L1 and L2 between the choke coils 21*a* and 21*b* and the high-voltage capacitor 20 can be shortened. As a result, the choke coils 21*a* and 21*b* and the high-voltage capacitor 20 are cooled directly, whereby these components can be prevented from being burnt. Furthermore, it is possible to reduce deterioration of the noise prevention performance of the magnetron apparatus. In addition, the shortening of the insulation distances L1 and L2 makes it possible to miniaturize the radio wave leakage prevention part 3 of the magnetron apparatus.

Furthermore, the supply port 23*a* is disposed to supply the insulating cooling liquid 22 into the space inside the filter case members 18*a* and 18*b.* Therefore, the insulating cooling liquid 22 can be supplied at the final manufacturing step (the cooling liquid supply step 84) for the magnetron apparatus. As a result, it is possible to prevent contamination due to spill and splash of the insulating cooling liquid 22 at steps before the final step. Consequently, it is not necessary to take measures against contamination by the insulating cooling liquid 22 at steps before the final step. For example, at the steps before the final step, it is not necessary to set contamination prevention covers or to remove the insulating cooling liquid 22 attached to assembling table and/or floors by the spill and splash in production lines. This makes it possible to produce the magnetron apparatus easily.

Apart from the aforementioned manufacturing, in order to improve the cooling effect by using the insulating cooling liquid 22, the insulating cooling liquid 22 may be subjected to forced convection in the space inside the filter case members 18*a* and 18*b.* More specifically, in addition to the supply port 23*a,* an outlet port 23*b* indicated by two-dot lines may be disposed on the filter case member 18*a.* And the supply port 23*a* and the outlet port 23*b* may be connected to a cooling liquid storage tank 31 (FIG. 2) installed outside, so that the insulating cooling liquid 22 can be forcibly supplied and discharged through the supply port 23*a* and the outlet port 23*b.* That is, it is possible, for example, to connect the supply port 23*a* and the outlet port 23*b* to the storage tank 31 installed outside to store the insulating cooling liquid 22 and having a circulation pump. As a result, the insulating cooling liquid 22 can be forcibly circulated between the space inside the filter case members 18*a* and 18*b* and the storage tank. This makes it possible to cool the choke coils 21*a* and 21*b* and the high-voltage capacitor 20 used as the LC filter circuit components more efficiently. Consequently, the cooling can prevent the components thereof from being burnt, and can reduce deterioration of the noise prevention performance of the magnetron apparatus.

In addition, the electrically conductive gasket 17 is disposed above the magnet 15*a* via the yoke member 16*a.* Therefore, when the magnetron apparatus is installed in a microwave appliance 70, the tightening force for the installation is not directly applied from the waveguide 70*a* of the microwave appliance 70 to the first magnet 15*a.* As a result, it is possible to prevent the first magnet 15*a* from undergoing damage, such as breakage.

In the aforementioned explanation, although the through-type high-voltage capacitor 20 and the choke coils 21*a* and 21*b* are used as the examples of the LC filter circuit components, the present embodiment is not limited to this configuration, and it is possible to use other components capable of suppressing high-frequency noise.

[Working Example]

Next, the results of comparison conducted by the inventors to confirm the effects of the present invention will be described below.

In the magnetron apparatus according to the present embodiment (hereinafter referred to as a "present example"), a coolant liquid (Perfloro Carbon Coolant FX-3300) made by Sumitomo 3 M Ltd. was used as the insulating cooling liquid 22 in the space inside the filter case members 18*a* and 18*b.* Furthermore, the application voltage of the magnetron apparatus during operation was set at 5 kV.

In comparison with this, a magnetron apparatus (hereinafter referred to as a "comparison example") was also produced, the specifications of which were the same as those described above, except for the insulating cooling liquid 22 supplied into the space inside the filter case members 18*a* and 18*b.*

Next, in the present example and the comparison example, metal pieces (not shown) having various heights (thicknesses) were connected and secured to the top and bottom inner surfaces of the filter case members 18*a* and 18*b* facing the choke coils 21*a* and 21*b* so as to afford various insulation distances. Measurements were then conducted with different insulation distances L1 and L2 (FIG. 1) between the choke coils 21*a* and 21*b* and the filter case members 18*a* and 18*b,* thereby obtaining the following results.

In the case of the present example, the insulation distances L1 and L2 were in the range of 22 to 26 mm. On the other hand, in the case of the comparison example, the insulation distances L1 and L2 were in the range of 51 to 60 mm. Then, it is understood that the insulation distances L1 and L2 of the present example can be shortened to about half in comparison with those of the comparison example.

<<Second Embodiment>>

Figure 4:
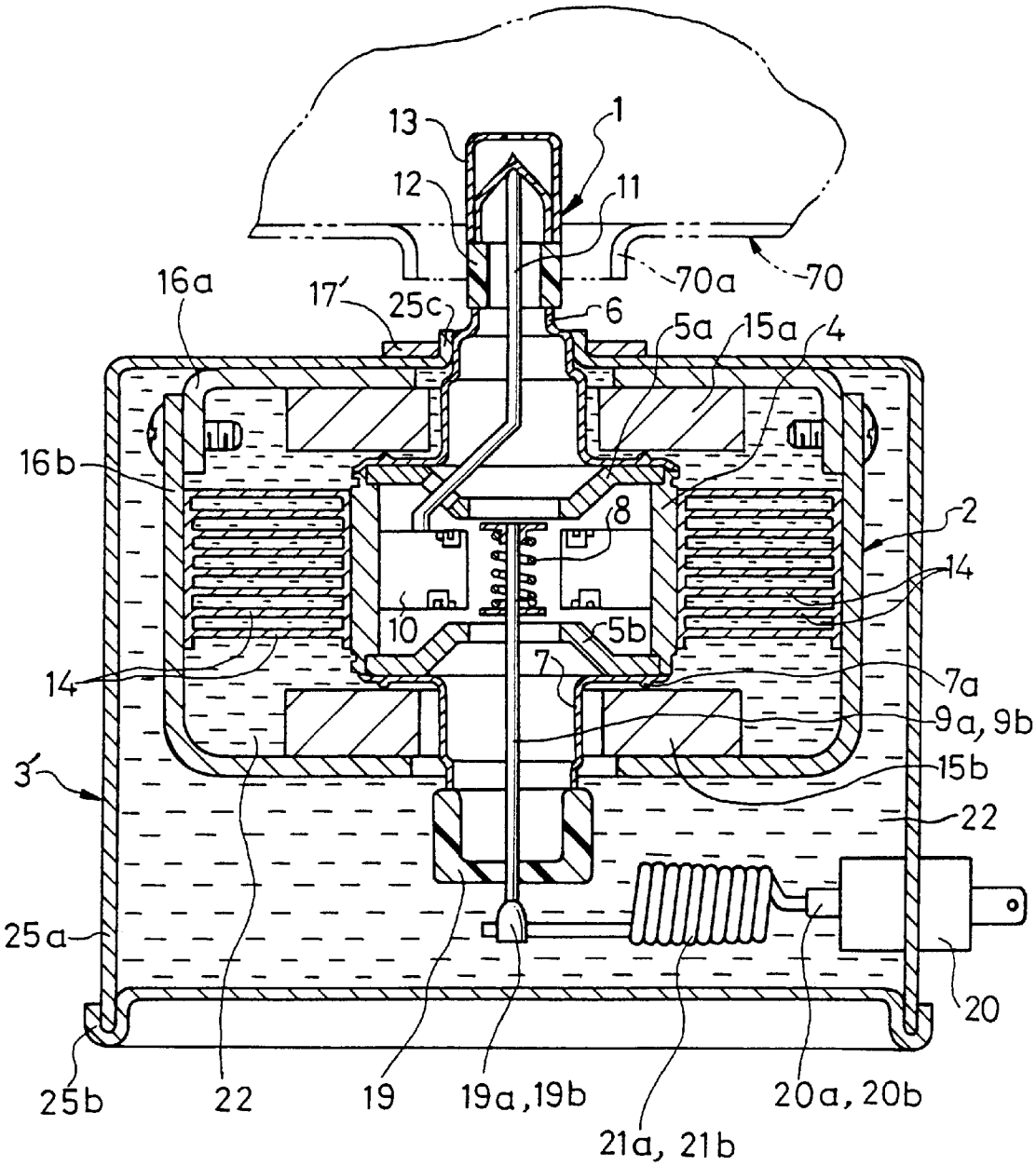
FIG. 4 is a sectional view showing a configuration of a magnetron apparatus in a second embodiment of the present invention.
Figure 5:
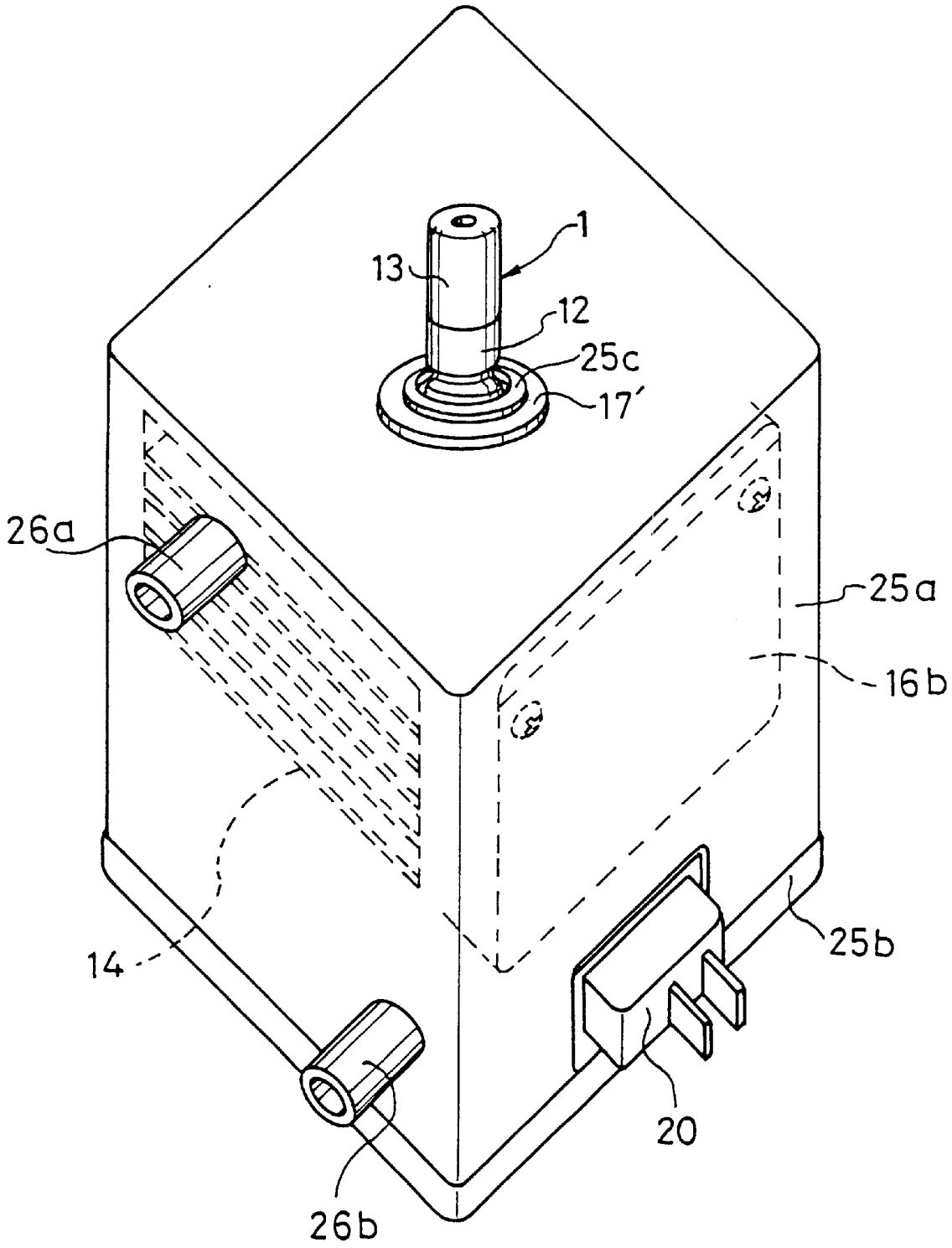
FIG. 5 is a perspective view showing the configuration of the magnetron apparatus shown in FIG. 4.

FIG. 4 is a sectional view showing a configuration of a magnetron apparatus in accordance with a second embodiment of the present invention. FIG. 5 is a perspective view showing the configuration of the magnetron apparatus shown in FIG. 4. In this embodiment, the magnetron apparatus is configured such that the magnetic circuit part is disposed in the filter case of the radio wave leakage prevention part, whereby the tubular anode, first and second magnets and fins can be cooled directly by the insulating cooling liquid. Since other portions are the same as those of the first embodiment, explanations of them are omitted to prevent overlaps.

As shown in FIG. 4, the magnetic circuit part 2 of the magnetron apparatus according to this embodiment is enclosed and contained with the filter case members 25*a* and 25*b* of a radio wave leakage prevention part 3'. As a result, when the space inside the filter case members 25*a* and 25*b* is filled with the insulating cooling liquid 22 as shown in FIG. 4, the first and second magnets 15*a* and 15*b,* the tubular anode 4 and the cooling fins 14 disposed in the space inside the frame-shaped yoke members 16*a* and 16*b,* as well as the above-mentioned LC filter circuit components, are dipped in the insulating cooling liquid 22, and cooled directly.

In the magnetron apparatus of the present embodiment, as shown in FIG. 5, a supply port 26*a* is disposed facing the end of the plurality of cooling fins 14 so that the insulating cooling liquid 22 can easily pass through the gaps among the cooling fins 14. A draw-worked portion 25*c* is provided for sealing at the central portion of the filter case member 25*a*. The first metal cylinder 6*a* of the magnetron portion 1 is press-fitted into the draw-worked portion 25*c*. After this, the draw-worked portion 25*c* is joined to the first metal cylinder 6*a* by brazing, welding or the like to ensure sealing therebetween. Furthermore, the apparatus is connected to the waveguide 70*a* via an electrically conductive gasket 17'.

According to the present embodiment, it is possible to obtain the below-mentioned technical advantages.

The choke coils 21*a* and 21*b* and the high-voltage capacitor 20 in the space inside the filter case members 25*a* and 25*b* are cooled by the insulating cooling liquid 22 as a matter of course. In addition, the magnets 15*a* and 15*b* in the space inside the yoke members 16*a* and 16*b* are also cooled by the insulating cooling liquid 22. Therefore, it is possible to prevent deterioration of the noise prevention performance of the magnetron apparatus as a matter of course, and it is also possible to reduce drop in the output of the magnetron apparatus.

Since the magnetic circuit part 2 is contained and enclosed with the filter case members 25*a* and 25*b,* it is not necessary to change the conventional main components, such as the magnetron part 1 and the magnetic circuit part 2. As a result, it is not necessary to prepare new working facilities, such as metal molds for the above-mentioned main components. Further, it is possible to eliminate the use of the rubber packing 24 and the like, which are necessary for the above-mentioned first embodiment.

Since the plurality of cooling fins 14 are provided at the outer peripheral portion of the tubular anode 4, the first and second magnets 15*a* and 15*b* and the tubular anode 4 are further cooled by the insulating cooling liquid 22.

Furthermore, since the supply port 26*a* is provided facing the end faces of the cooling fins 14, the insulating cooling liquid 22 can easily pass through the gaps among the cooling fins 14, thereby further improving the heat radiation effect of the cooling fins 14.

The configuration wherein the supply port 26*a* and the outlet port 26*b* are disposed on the filter case member 25*a* is described in the explanation of the second embodiment. However, without being limited to this configuration, it is possible to use a configuration wherein only the supply port 26*a* is disposed on the filter case member 25*a*. Furthermore, apart from the second embodiment configuration having the supply port 26*a* and the outlet port 26*b* are disposed on the same side face of the filter case 25*a,* these ports can be disposed on different side faces of the filter case member 25*a* or on the faces of the filter case member 25*b* or the like.

<<Third Embodiment>>

Figure 6:
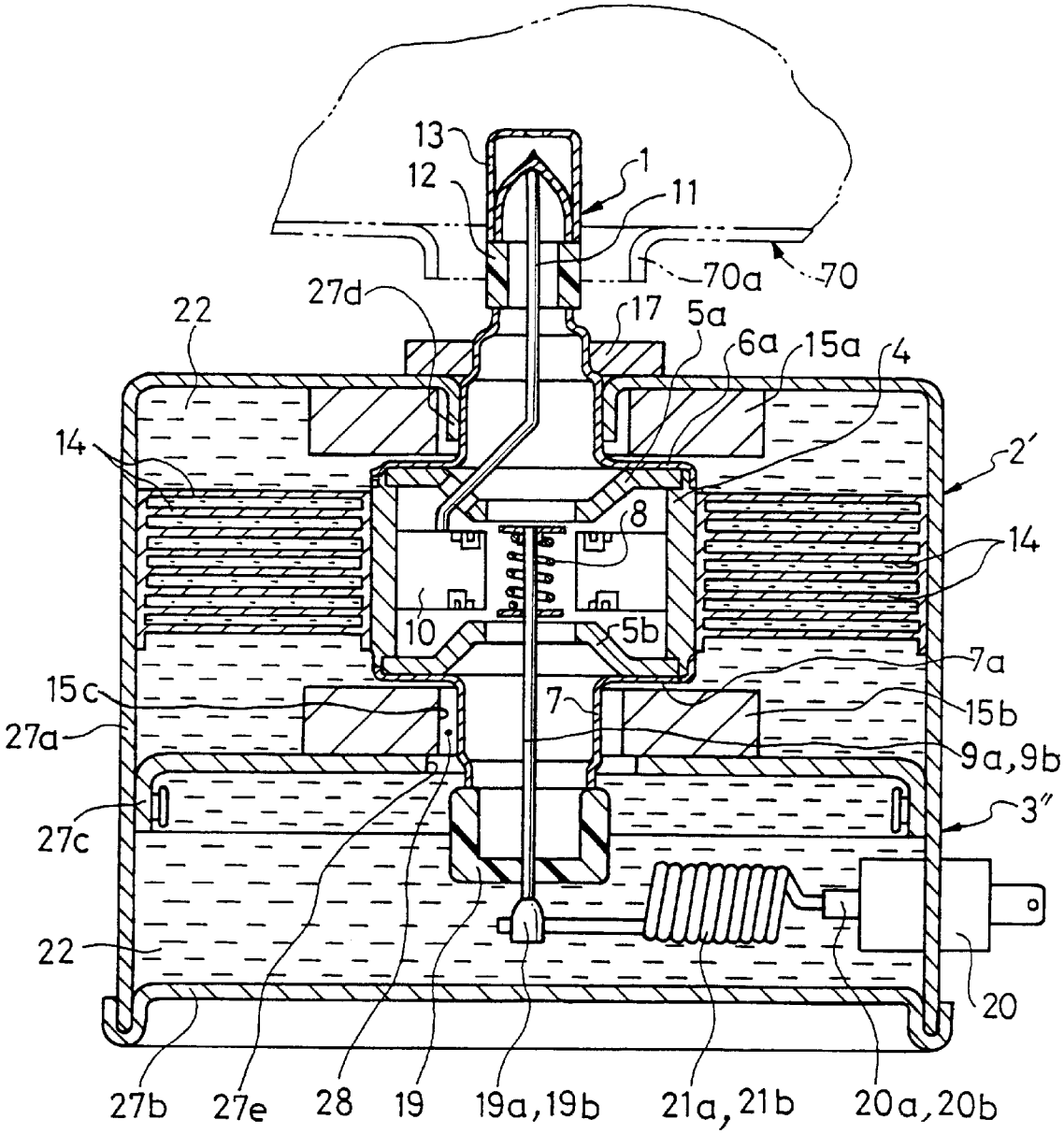
FIG. 6 is a sectional view showing a configuration of a magnetron apparatus in a third embodiment of the present invention.
Figure 7:
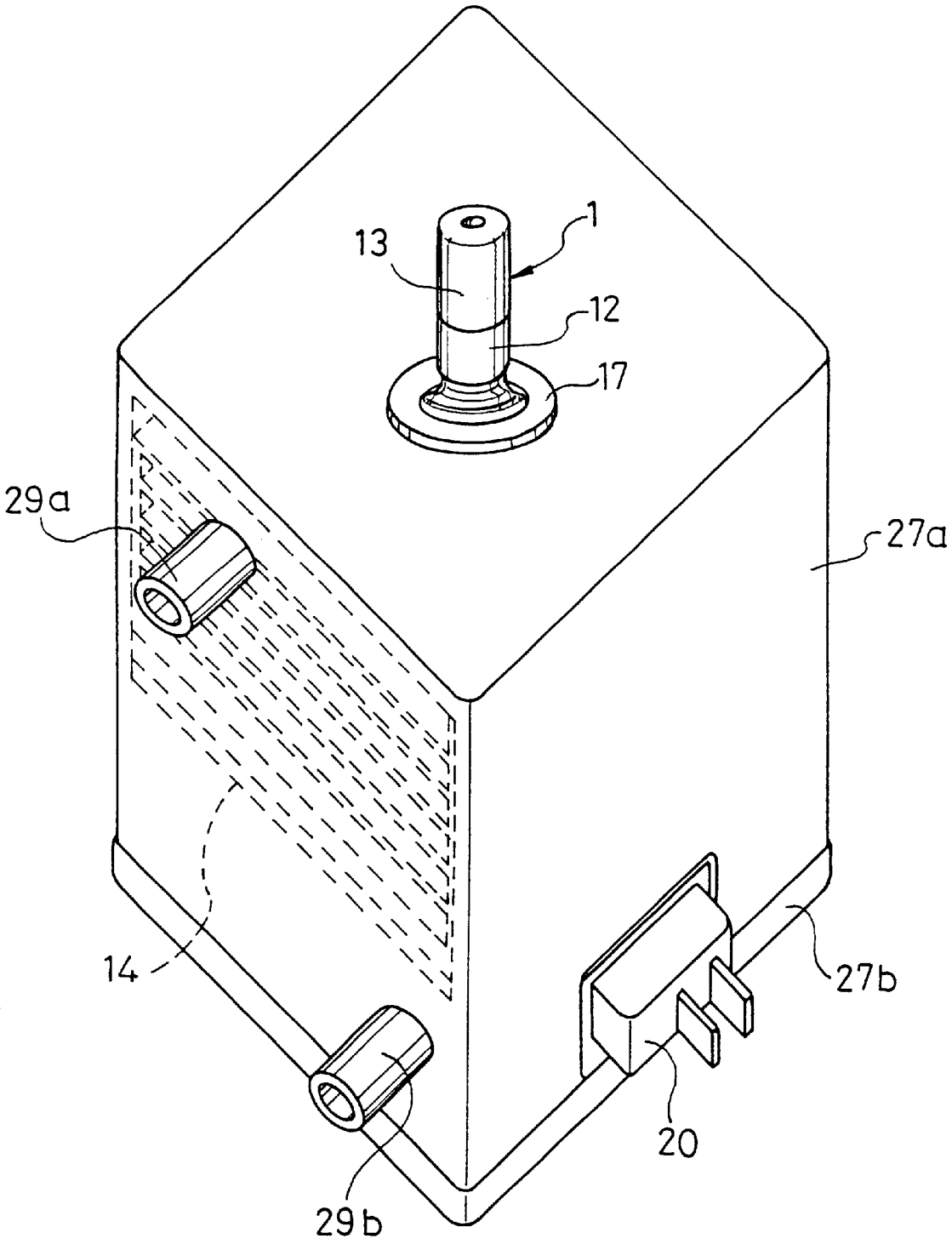
FIG. 7 is a perspective view showing the configuration of the magnetron apparatus shown in FIG. 6.
Figure 8:
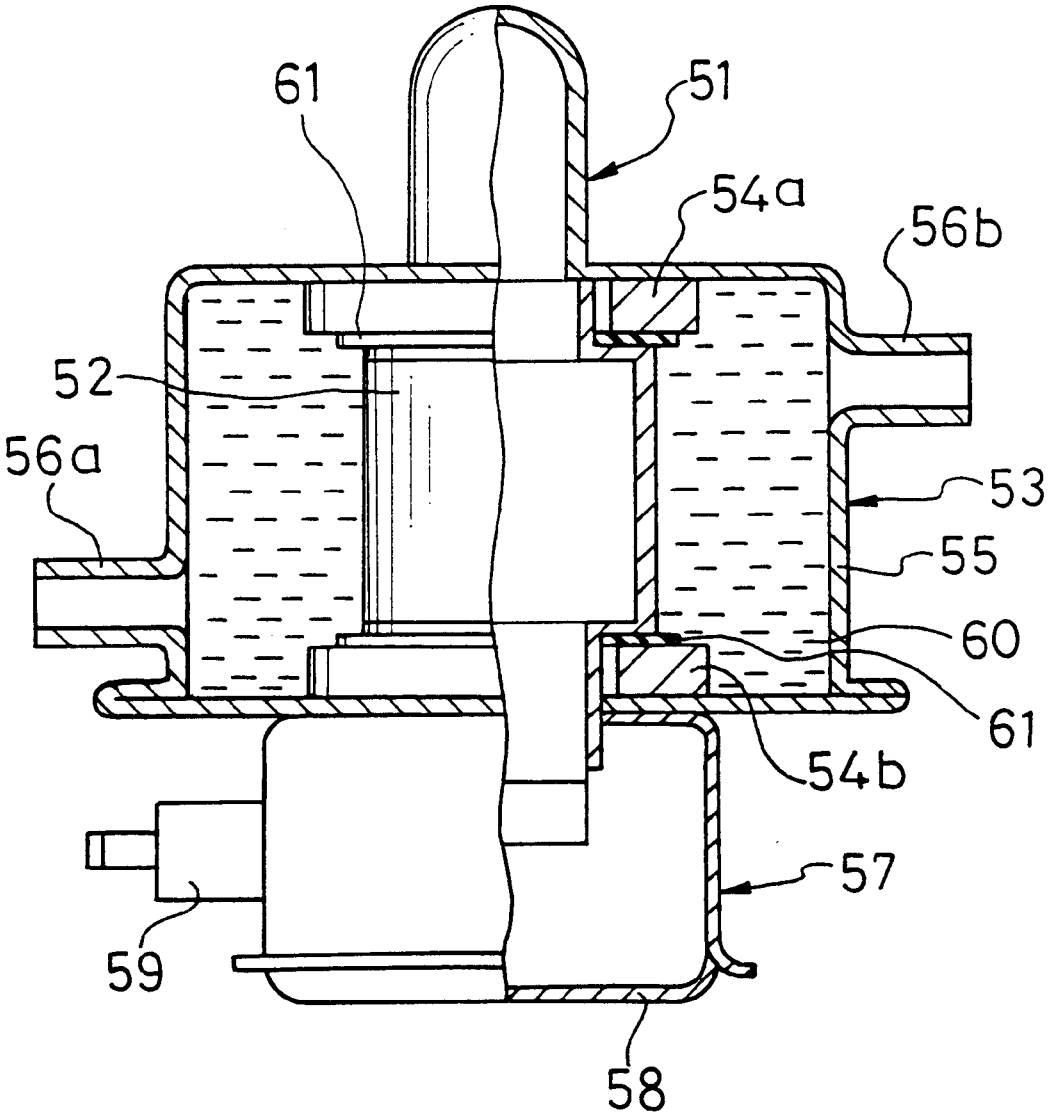
FIG. 8 (Prior Art)
FIG. 8 is a partially cutaway sectional view showing a configuration of a conventional magnetron apparatus.

FIG. 6 is a sectional view showing a configuration of a magnetron apparatus a third embodiment of the present invention. FIG. 7 is a perspective view showing the configuration of the magnetron apparatus shown in FIG. 6. In the configuration of the magnetron apparatus of this embodiment, a yoke is a part of the filter case. Since other portions are the same as those of the first embodiment, explanations of them are omitted to prevent overlaps.

As shown in FIG. 7, in the magnetron apparatus according to the present embodiment, the tubular anode 4, first and second magnets 15*a* and 15*b* and the like are enclosed in a space inside filter case members 27*a* and 27*c,* made of iron and also used as yoke members, thereby to form a magnetic circuit part 2'. A high-voltage capacitor 20 and choke coils 21*a* and 21*b* are provided in a space enclosed with the filter case members 27*b* and 27*c*. In addition, a space inside the filter case members 27*a* and 27*b* is sealed so that the insulating cooling liquid 22 makes contact with the first and second magnets 15*a* and 15*b,* the tubular anode 4, the cooling fins 14 and the like of the magnetic circuit part 2'.

As shown in FIG. 7, a supply port 29*a* is provided facing the end faces of the plurality of cooling fins 14 so that the insulating cooling liquid 22 can easily pass through the gaps among the cooling fins 14. A draw-worked portion 27*d* is disposed for sealing at the central portion of the filter case member 27*a*. The first metal cylinder 6*a* of the magnetron part 1 is press-fitted into the draw-worked portion 27*d*. After this, the draw-worked portion 27*d* is joined to the first metal cylinder 6*a* by brazing, welding or the like to ensure sealing therebetween. A communicating portion 28 is disposed in the filter case member 27*c* positioned between the magnetic circuit part 2' and the radio wave leakage prevention part 3" so that the insulating cooling liquid 22 can easily be supplied and discharged between the space inside the filter case members 27*a* and 27*c* and the space inside the filter case members 27*b* and 27*c*. The communicating portion 28 is used to communicate the space inside the magnetic circuit part 2' with the space inside the radio wave leakage prevention part 3". The communicating portion 28 is formed by using the insertion hole 27*e* in the filter case member 27*c* and the central hole 15*c* of the second magnet 15*b*.

According to the present embodiment, it is possible to obtain the below-mentioned technical advantages.

The filter case members 27*a* and 27*c* are used so that the filter case can also be used as a yoke. Therefore, it is possible to reduce the number of components of the apparatus, and to reduce the weight of the apparatus.

The choke coils 21*a* and 21*b* and the high-voltage capacitor 20 are cooled by the insulating cooling liquid 22 in the space inside the filter case members 27*c* and 27*b*. In addition, the magnets 15*a* and 15*b* and the tubular anode 4 in the space inside the filter case members 27*a* and 27*c* are also cooled by the insulating cooling liquid 22. Therefore, it is possible to prevent deterioration of the noise prevention performance of the magnetron apparatus as a matter of course, and it is also possible to reduce drop in the output of the magnetron apparatus during the service period.

Since the magnetic circuit part 2' is contained and enclosed with the filter case members 27*a* and 27*c,* it is not necessary to change the conventional main components, such as the magnetron part 1, the magnets 15*a* and 15*b* and the like. As a result, it is not necessary to prepare new working facilities, such as metal molds for the above-mentioned main components.

Furthermore, the communicating portion 28 is disposed in the filter case member 27*c* by using the central hole 15*c* of the second magnet 15*b*. Therefore, a difference in temperature occurs between the insulating cooling liquid 22 inside the magnetic circuit part 2' and the insulating cooling liquid 22 inside the radio wave leakage prevention part 3" during operation of the apparatus. This causes circulation (natural convection) of the insulating cooling liquid 22 between the magnetic circuit part 2' and the radio wave leakage prevention part 3". As a result, the temperature of the insulating cooling liquid 22 inside the magnetic circuit part 2' and the radio wave leakage prevention part 3" can be maintained at a constant value at all times, and the magnet 15*b* can be cooled. Consequently, this stabilizes the noise prevention performance and the output performance of the magnetron apparatus.

The structure wherein the communicating portion 28 is formed by using the central hole 15*c* of the magnet 15*b* is described in the explanation of the third embodiment. However, without being limited to this structure, it is possible to use a structure wherein one or more holes are provided on the surface of the filter case member 27*c* making contact with the second magnet 15*b,* for example. Alternatively, it is also possible to use a structure wherein the ring-shaped packing 24 shown in FIG. 1, a silicone-based adhesive and the like, for example, are used, without using the communicating portion 28.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A magnetron apparatus comprising:

a magnetron having a tubular anode and a cathode, a magnetic circuit having first and second magnets disposed around the upper and lower opening end portions of said tubular anode, respectively, and a yoke disposed enclosing said tubular anode and said first and second magnets, a radio wave leakage preventor having a filter case and LC filter circuit components disposed inside said filter case, and an insulating cooling liquid filled in at least said filter case, wherein said magnetic circuit is enclosed in said filter case.

2. A magnetron apparatus in accordance with claim 1, wherein said tubular anode of said magnetron has cooling fins around the outer peripheral portion of said tubular anode.

3. A magnetron apparatus in accordance with claim 1, wherein said insulating cooling liquid is supplied from a supply port.

4. A magnetron apparatus in accordance with claim 3, wherein said insulating cooling liquid is discharged from an outlet port.

5. A magnetron apparatus in accordance with claim 4, wherein a cooling liquid storage tank is provided between said supply port and said outlet port, so that said insulating cooling liquid circulates.

6. A magnetron apparatus in accordance with claim 1, wherein inside a space of said yoke is filled with said insulating cooling liquid.

7. A magnetron apparatus in accordance with claim 2, wherein said yoke is a part of the filter case.

8. A magnetron apparatus in accordance with claim 1, wherein said yoke is a part of the filter case.

9. A magnetron apparatus in accordance with claim 8, wherein a communicating portion is provided for communicating the space inside said magnetic circuit with the space inside said radio wave leakage preventor.

10. A magnetron apparatus in accordance with claim 9, wherein said communicating portion is provided with the central hole of one of said magnets disposed on the side of said radio wave leakage preventor.

11. A magnetron apparatus in accordance with claim 2, wherein said insulating cooling liquid is supplied from a supply port.

12. A magnetron apparatus in accordance with claim 11, wherein said insulating cooling liquid is discharged from an outlet port.

13. A magnetron apparatus in accordance with claim 12, wherein a cooling liquid storage tank is provided between said supply port and said outlet port, so that said insulating cooling liquid circulates.

14. A magnetron apparatus in accordance with claim 2 wherein inside a space of said yoke is filled with said insulating cooling liquid.

15. A magnetron apparatus in accordance with claim 2, wherein a communicating portion is provided for communicating the space inside said magnetic circuit with the space inside said radio wave leakage preventor.

16. A magnetron apparatus in accordance with claim 15, wherein said communicating portion is provided with the central hole of one of said magnets disposed on the side of said radio wave leakage preventor.

17. A method for manufacturing a magnetron apparatus comprising a magnetron, a magnetic circuit and a radio wave leakage preventor, wherein said magnetic circuit and LC filter components are enclosed in a filter case of said radio wave leakage preventor, comprising:

connecting said magnetic circuit and said radio wave leakage preventor; and after connecting said magnetic circuit and said radio wave leakage preventor to each other, supplying an insulating cooling liquid into the filter case of said radio wave leakage preventor.

* * * * *